United States Patent [19]

Konishi et al.

[11] 4,016,852

[45] Apr. 12, 1977

[54] APPARATUS FOR PREVENTING AFTER-BURNING IN INTERNAL COMBUSTION ENGINE

[75] Inventors: Masami Konishi, Toyota; Hiromichi Yanagihara, Susono, both of Japan

[73] Assignee: Toyota Jidosha Kogyo Kabushiki Kaisha, Toyota, Japan

[22] Filed: Aug. 11, 1975

[21] Appl. No.: 603,356

[30] Foreign Application Priority Data

Apr. 19, 1975 Japan ..... 50-048022

[52] U.S. Cl. ..... 123/198 DB; 123/DIG. 11; 123/97 B; 123/119 F

[51] Int. Cl.[2] ..... F02M 19/12

[58] Field of Search ..... 123/DIG. 11, 198 D, 123/198 DB, 119 F, 97 B, 179 BG, 179 G, 180 E, 103

[56] References Cited

UNITED STATES PATENTS

| | | | |
|---|---|---|---|
| 3,517,653 | 6/1970 | Ariga et al. | 123/DIG. 11 |
| 3,741,177 | 6/1973 | Schultz | 123/DIG. 11 |
| 3,741,178 | 6/1973 | Cedar | 123/DIG. 11 |
| 3,744,470 | 7/1973 | Clarke et al. | 123/DIG. 11 |
| 3,744,471 | 7/1973 | Brown et al. | 123/DIG. 11 |
| 3,841,281 | 10/1974 | Mick | 123/DIG. 11 |

*Primary Examiner*—C. J. Husar
*Assistant Examiner*—Ira S. Lazarus
*Attorney, Agent, or Firm*—Woodhams, Blanchard and Flynn

[57] ABSTRACT

An apparatus to prevent after-burning, after the ignition key switch is turned off, in an internal combustion engine which is being warmed up, in which condition the choke valve is closed and the throttle valve is opened to a greater extent than during normal idling. The apparatus includes a pressure responsive actuator which, when activated, causes opening of the choke valve and/or closing of the throttle valve. The actuator is controlled by a switching valve which permits the actuator to be interconnected to either the open air or the air intake manifold at a location downstream of the throttle valve. When the igniton key switch is moved into an off or open position, the switching valve connects the actuator to the intake manifold to thereby actuate the actuator so that one or both of the throttle and control valves are appropriately moved.

7 Claims, 5 Drawing Figures

APPARATUS FOR PREVENTING AFTER-BURNING IN INTERNAL COMBUSTION ENGINE

FIELD OF THE INVENTION

The present invention relates to an apparatus for preventing after-burning in an internal combustion engine.

BACKGROUND OF THE INVENTION

It is a common practice during warming-up of an internal combustion engine to supply a larger quantity of a rich fuel-air mixture in comparison to normally idling, by closing the choke valve and slightly opening the throttle valve. The choke valve and the throttle valve are maintained closed and opened, respectively, until the temperature of the engine lubrication oil rises. This operation is done either manually or by means of an automatic choke mechanism.

However, explosive after-burning often occurs when an ignition key switch is turned off while warming up the engine with the choke valve closed. It takes some time before the engine stops completely under the effect of its inertia force. During this time, a large quantity of fuel is sucked and exhausted without being combusted. Then the fuel becomes ignited and combusted in the exhaust system of the engine. This is the reason why after-burning occurs.

An object of this invention is, therefore, to provide an apparatus for preventing such after-burning, even if the ignition key switch is turned off, in an internal combustion engine being warmed up, with its choke valve closed and its throttle valve opened to a greater extent than during normal idling.

Another object of this invention is to provide an apparatus for closing the throttle valve when the ignition key switch is turned off during warming-up.

Still another object of this invention is to provide an apparatus for opening the choke valve when the ignition key switch is turned off during warming-up.

This invention has been achieved by taking notice of the fact that the unburnt fuel-air mixture discharged into the exhaust system can be prevented from after-burning by decreasing the quantity of, and, further, lowering the ratio of fuel in the fuel-air mixture sent to the engine after turning off the ignition key switch. This can be attained by taking any of the following three steps on turning off the ignition key switch: (1) returning the throttle valve to an idling position; (2) opening the choke valve; or (3) returning the throttle valve to the idling position and opening the choke valve. Therefore, this invention provides a pressure responsive actuator which is actuated by the negative pressure in the air intake manifold. This pressure responsive actuator actuates the throttle valve and/or choke valve, and thus serves as an element to change the air-fuel ratio or the quantity of the air-fuel mixture supplied to the engine. More concretely, closing the throttle valve and/or opening the choke valve is done forcibly by this means.

BRIEF DESCRIPTION OF THE DRAWINGS

This invention will be described in detail with reference to the accompanying drawings, in which.

DETAILED DESCRIPTION

Figure 1:
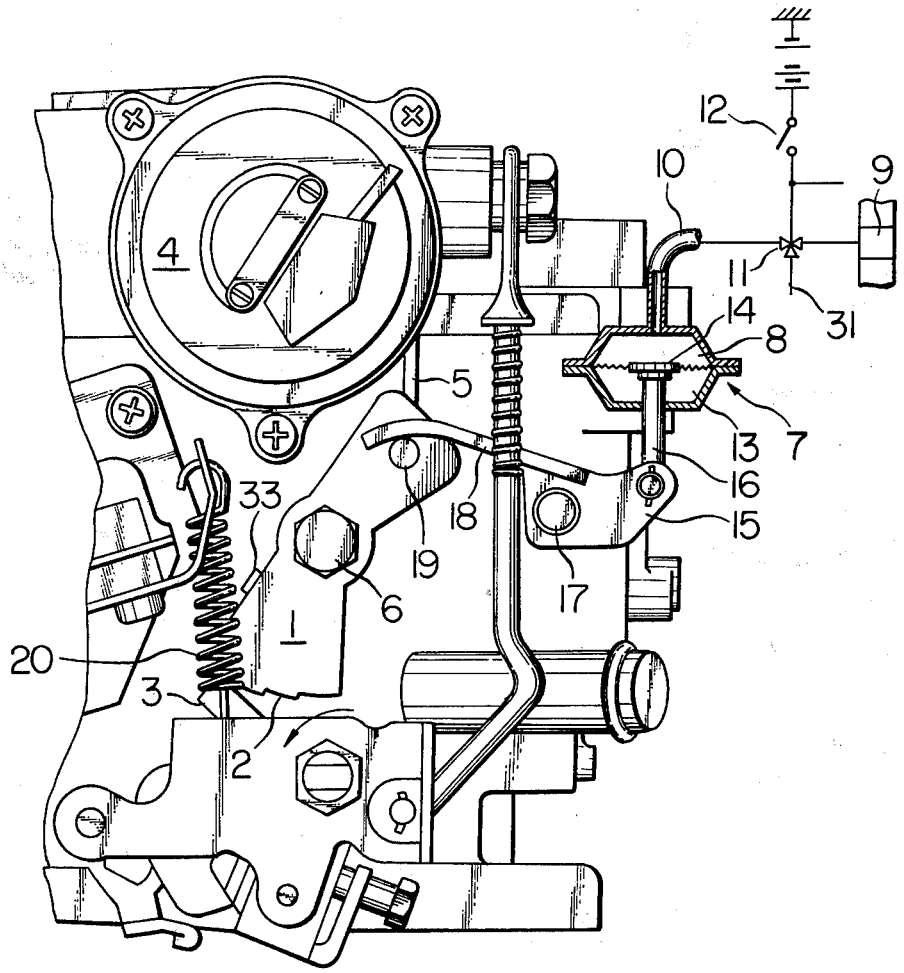
FIG. 1 is a front view showing an embodiment of this invention.
Figure 1A:
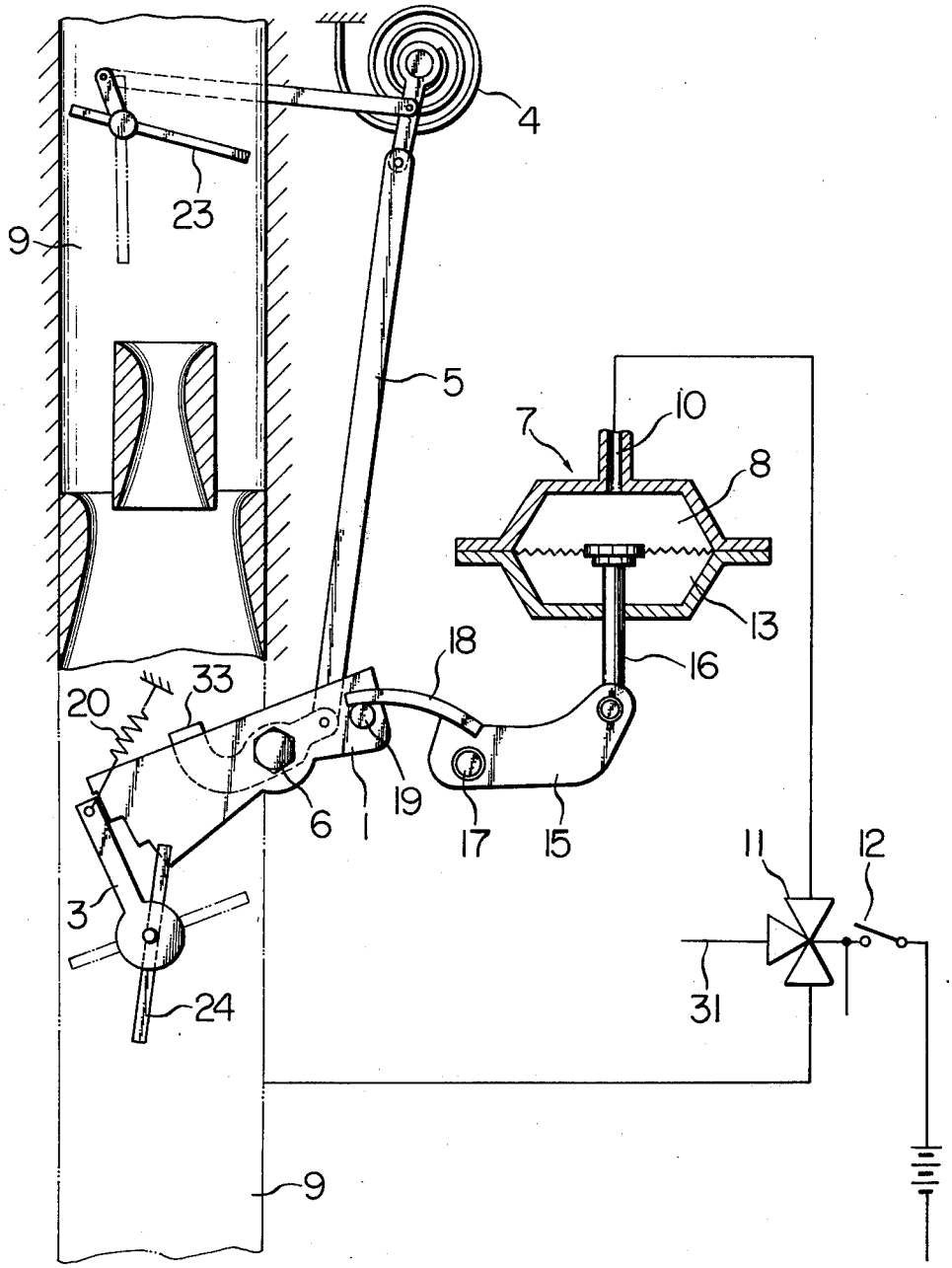
FIG. 1A is a system diagram for the embodiment of FIG. 1.

Referring first to FIGS. 1 and 1A, an embodiment is illustrated in which the throttle valve is moved in a closing direction when the ignition key switch is turned off.

This embodiment is concerned with a conventional automatic choke mechanism. A throttle valve actuation lever 3 is operated by a cam face 2 formed at an end of a FAST idle cam plate 1. Rotation of the FAST idle cam plate 1 is limited by a stop 33 connected to a rod 5 driven by a bimetal thermostatic device 4 associated with the automatic choke mechanism. The stop 33 is swingable around a shaft 6 as the choke is progressively released, whereby the FAST idle cam plate 1 also becomes rotatable on said shaft 6. When the stop 33 is not released, the FAST idle cam plate 1 may be rotated on the shaft 6 by applying external force against the torque of the bimetal choke member 4.

In this embodiment, a pressure responsive actuator 7 is provided, and the FAST idle cam plate 1 is forcibly moved to close the throttle valve 4 by means of the negative pressure in an air intake manifold. Namely, the actuator 7 is, for instance, of the diagram type, and one of its working chambers 8 communicates through a conduit 10 with an air intake manifold 9 downstream of the throttle valve 24. In this conduit 10 is provided a change-over valve 11, which is electromagnetically switched so that the conduit 10 becomes connected to the air intake manifold 9 when an ignition key switch 12 is turned off, and to the open air via conduit 31 when said switch 12 is turned on. The other working chamber 13 of the actuator 7 communicates with the open air, and a rod 16 connected to one end of the lever 15 is fixed to the valve diaphragm 14. The lever 15 is rotatable around a fitting shaft 17. When a contact portion 18 on the other end of lever 15 comes in contact with and depresses a pin 19 mounted on the FAST idle cam plate 1, the cam 1 is rotated whereby the lever 3 becomes disengaged from the cam face 2. The lever 3 is always urged by a spring 20 toward a direction in which the throttle valve is closed.

The operation of the embodiment of FIGS. 1 and 1A will now be described.

The arrow in FIG. 1 indicates the direction in which the throttle valve is opened.

Assuming that the engine is being warmed up by operating the automatic choke mechanism, then the choke valve 23 is closed and the FAST idle cam plate 1 is rotated to the position illustrated in FIG. 1 so that the returning motion of the throttle valve actuation lever 3 is limited by the cam face 2, as a result of which the throttle valve 24 is opened to a greater extent than during normal idling. As the engine warms up, the choke valve is opened by displacement of the bimetal device 4 produced as a result of temperature rise caused by electrical heating. This displacement of device 4 is transmitted to the rod 5, thereby permitting the cam face 2 of the FAST idle cam plate 1 to move gradually. Then, as the lever 3 rotates due to the urging of spring 20, the throttle valve is automatically returned to the normal idling position to stop warming-up.

Let us assume now that the ignition key switch 12 is turned off before completion of the warming-up. Then, the change-over valve 11, which communicates with the open air via conduit 31 when the key switch 12 is closed, is switched over so that the air intake manifold 9 is connected to the working chamber 8 of the actuator 7. After turning off (i.e. opening) the ignition key switch 12, some time elapses before the engine really stops, owing to the inertia of the engine. Consequently, a high negative pressure exists in the air intake manifold 9. This destroys the balance between the pressure in the working chamber 8 and the atmospheric pressure in the other working chamber 13, whereby the rod 16 is moved upward. This causes the lever 15 to rotate about the fitting shaft 17, and the contact portion 18 forcibly depresses the pin 19 and rotates the cam 1 to disengage the cam face 2 from the lever 3. As a consequence, the lever 3 is turned by the spring 20 in a direction in which the throttle valve becomes closed.

The occurrence of the after-burning phenomenon is prevented by thus decreasing the quantity of and, further, lowering the ratio of fuel in the fuel-air mixture supplied to the engine while it is still operating under the effect of its inertia.

Figure 2:
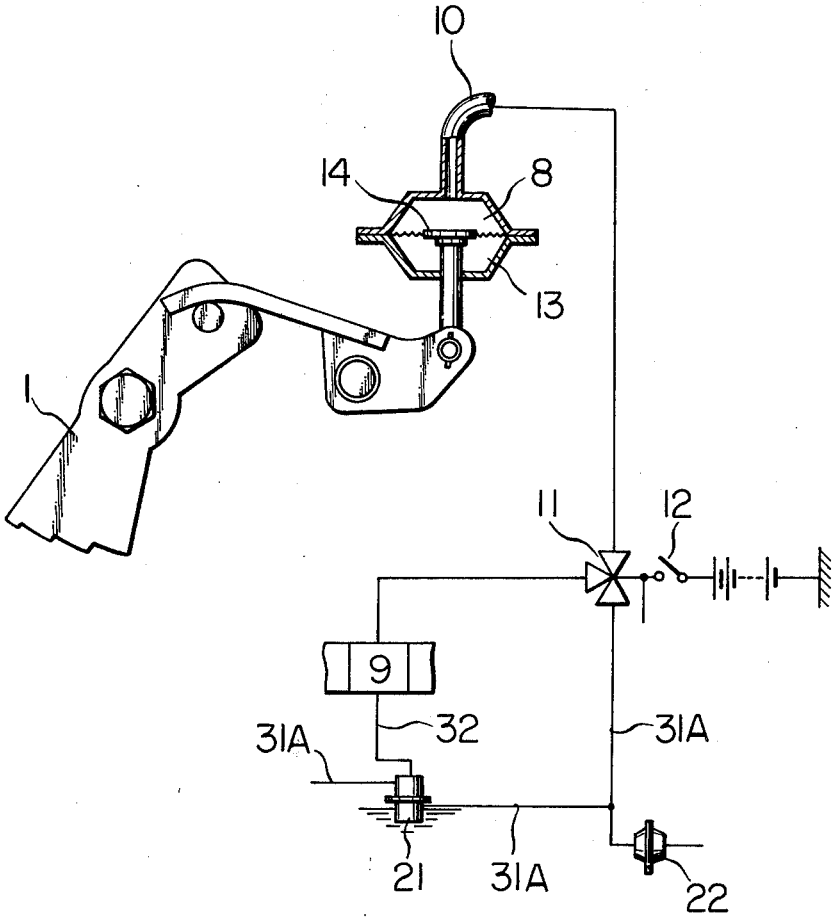
FIG. 2 is a system diagram showing another embodiment of the negative pressure operation circuit useable in FIG. 1.

Referring next to FIG. 2, another embodiment of the negative-pressure working system will be described.

In this embodiment, the working chamber 8 is not always connected to the open air while the ignition key switch 12 is turned on, and is thus different from the system illustrated in FIG. 1. Instead, the negative pressure in the air intake manifold acts on the working chamber 8 so as to close the throttle valve, even if the ignition key switch 12 is turned on, when the temperature of the engine cooling water rises and warmingup becomes unnecessary.

In this embodiment, the circuit 31A connecting the changeover valve 11 to the open air is also connected to the air intake manifold 9 by a conduit 32. A bimetallic vacuum switching valve 21 is connected therebetween. Further, an ignition retarder 22 is provided. This bimetallic vacuum switching valve 21 is placed in a circuit for the engine cooling water, and connects the working chamber 8 to the open air when the temperature of the cooling water is low, and to the air intake manifold 9 when said temperature is high. It is popularly used as an actuation device for the ignition retarder 22. In this embodiment, said known device is used to simplify the structure of the entire apparatus.

The operation of the FIG. 2 embodiment will be described in the following.

When the temperature of the engine cooling water is low, the bimetallic vacuum switching valve 21 is opened to the outside air, and therefore atmospheric pressure acts on the working chamber 8 through the conduit 31A. On turning off the ignition key switch 12, it operates in the same manner as with the embodiment shown in FIG. 1 in that valve 11 connects chamber 8 directly to the intake manifold pipe 9, thereby closing the throttle valve by releasing the FAST idle cam.

When the temperature of the engine cooling water rises, the bimetallic vacuum switching valve 21 works to switch the connection from the open air to the air intake manifold pipe 9 by connecting conduit 32 to conduit 31A. Thus, the negative pressure in the air intake manifold acts on the working chamber 8 even when the ignition key switch is on, thereby releasing the FAST idle cam when warm up is unnecessary.

Figure 3:
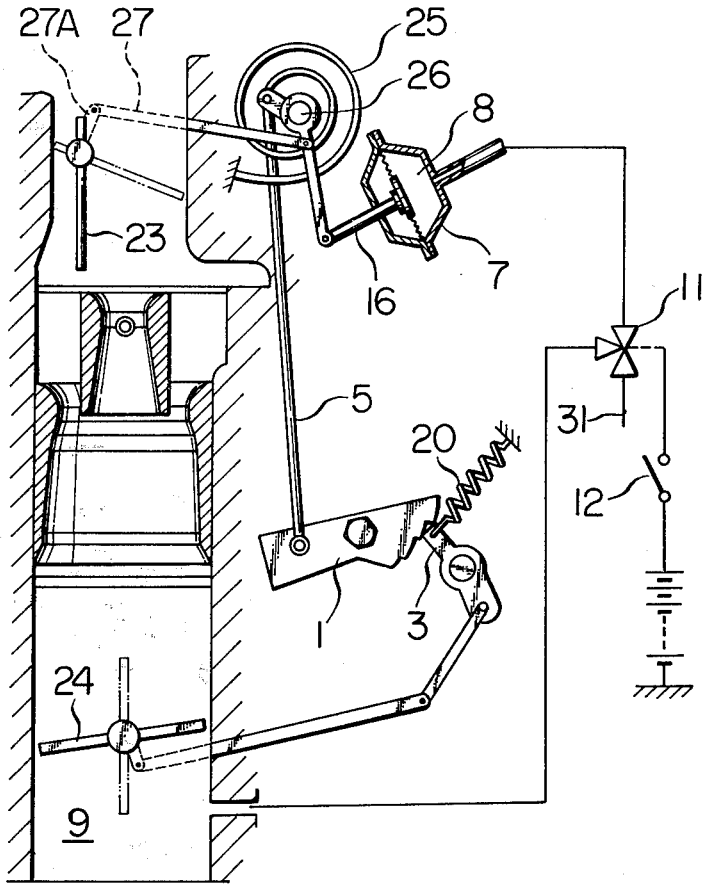
FIG. 3 is a schematic view showing another embodiment of this invention.

FIG. 3 schematically illustrates another embodiment of this invention, in which the choke valve is opened when the ignition key switch is turned off.

First, a brief description will be given as to its structure. In the air intake manifold 9 there is provided the choke valve 23 and the throttle valve 24, which are operated by an automatic choke mechanism when warming up the engine. Said automatic choke mechanism includes a conventional bimetal thermostat 25, a FAST idle cam plate 1, an actuation lever 3 for said throttle valve 24, a rod 5 connecting said thermostat 25 with said FAST idle cam plate 1, and a spring 20 connected to said actuation lever 3 so as to urge it in a direction in which said throttle valve 24 becomes closed. A negative-pressure responsive actuator 7 is interconnected to the shaft 26, which is interconnected to the choke valve 23 by means of a link 27 and lever 27A. The actuator 7 is actuated by the negative-pressure working circuit shown in FIG. 1 (or FIG. 2).

The following paragraphs describe the operational phase of the FIG. 3 embodiment composed as described above.

On starting the warming-up by operating the automatic choke mechanism, the choke valve 23 and the throttle valve 24 respectively come into the positions shown by dot-dash lines in FIG. 3, whereby a relatively large quantity of rich fuel-air mixture is supplied to the engine through the air intake manifold 9. When the ignition key switch 12 is turned off during this warming-up operation, the change-over valve 11 switches its connection from the open air 31 to the air intake manifold 9 downstream of the throttle valve 24, whereupon the negative pressure in said air intake manifold 9 works on the working chamber 8 of the actuator 7 and moves the rod 16 inwardly. This rotates the shaft 26 and moves the lever 27A downward to open the choke valve 23. At this time, said shaft 26 may be rotated either in such a manner as to disengage the FAST idle cam 1 from the lever 3 or independently so as to not effect the position of the cam 1. In the case wherein the FAST idle cam 1 is disengaged from lever 3 by rotation of shaft 26, the throttle valve 24 is simultaneously closed (due to urging of spring 20) when valve 23 is opened, thereby increasing the effect of preventing after-burning.

Figure 4:
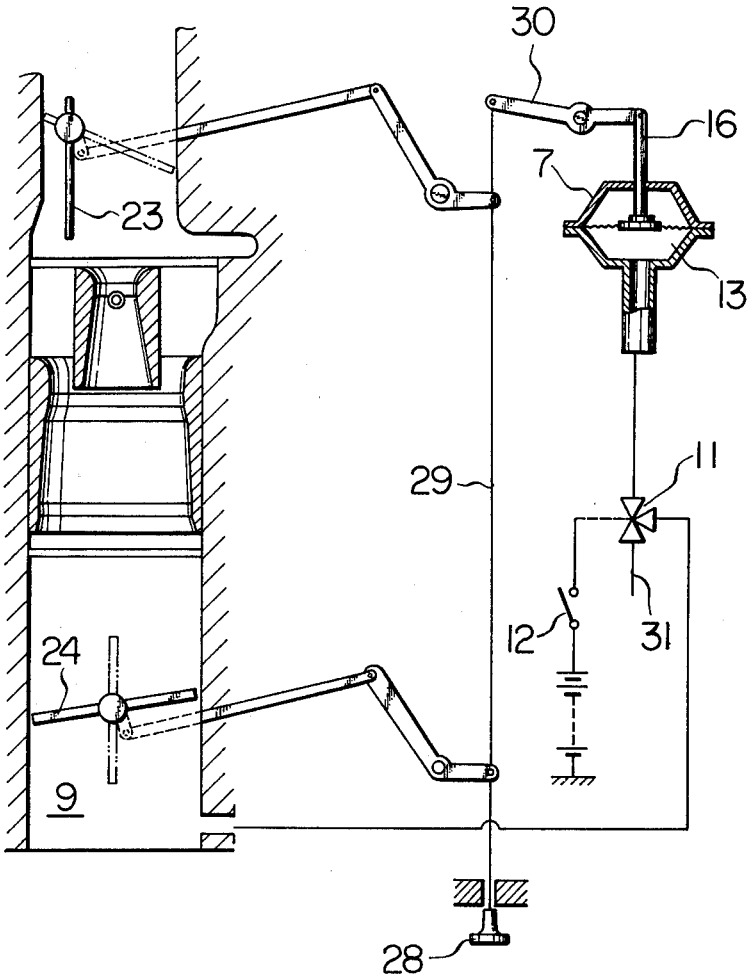
FIG. 4 is a schematic view showing still another embodiment of this invention.

Referring next to FIG. 4, still another embodiment of this invention relating to a carburetor will be described, in which warming-up is performed by manually closing a choke valve.

The choke valve 23 and the throttle valve 24 provided in the air intake manifold 9 are opened and closed by means of a choke member 28. When pulling (downwardly in FIG. 4) said choke member 28, the choke valve 28 closes, and the throttle valve 24 slightly opens. A lever 30 is fitted to part of the operating system of said choke member 28; for instance, to a wire 29 in the illustrated embodiment. To this lever 30 is fixed the above-mentioned rod 16 connected to the negative-pressure responsive actuator 7.

In this embodiment, warming-up is performed by pulling downwardly said choke member 28, which causes rod 16 to be moved upwardly. On turning off the ignition key switch 12, the valve 11 is switched so that the chamber 13 is connected to the negative pressure in the manifold 9. Thus, rod 16 is moved downwardly and the lever 30 is rotated to return the choke member 28 to its original position. Therefore, the choke valve 23 and the throttle valve 24 are forcibly moved from the positions shown by dot-dash lines to those shown by solid lines, thereby preventing after-burning.

This embodiment involving manual operation should not be limited to the illustrated one. For example, the actuator 7 may be adapted to open or close only one of the choke and throttle valves.

As understood from the above, this invention can prevent after-burning effectively. It improves the durability of the equipment for the exhaust system, such as the thermal reactor and the exhaust muffler. Also, it relieves the driver and passenger from an unpleasant feeling.

The embodiments of the invention in which an exclusive property or privilege is claimed are defined as follows:

1. A fuel supply apparatus adapted for use with an internal combustion engine having ignition switch means, said apparatus comprising an air intake manifold having movable throttle and choke valves associated therewith, a fast idle cam operatively associated with the throttle valve for moving same into a fast idle position during warmup of the engine, and an automatic choke mechanism operatively coacting between the choke valve and the fast idle cam for substantially closing the choke valve and for moving the fast idle cam into a fast idle position during warmup of an engine, the improvement comprising control means operatively interconnected to said fast idle cam for forceably moving same away from said fast idle position to permit the throttle valve to be returned from its fast idle position into a substantially closed position upon stoppage of the engine when the automatic choke mechanism is set in a fast idle condition, said control means including pressure-responsive actuator means operatively connected with said fast idle cam, passage means communicating with said pressure-responsive actuator means for supplying a pressure fluid thereto to permit actuation thereof in response to the pressure level of said fluid, changeover valve means associated with said passage means to control the flow therethrough and being shiftable in response to opening and closing of the ignition switch means, first passageway means communicating said valve means with the surrounding atmosphere, and second passageway means communicating said valve means with said air intake manifold, whereby said valve means permits said pressure-responsive actuator means to selectively alternately communicate with said first and second passageway means so that actuation of said actuator means effects movement of said fast idle cam for permitting said throttle valve to be returned from its fast idle position to its closed position.

2. An apparatus according to claim 1, including valve switching means associated with said first passageway means and responsive to the temperature of the engine cooling fluid, said valve switching means being located upstream of said changeover valve means, said valve switching means permitting said first passageway means to remain in communication with the open air when the engine cooling fluid temperature is below a predetermined magnitude, and said valve switching means causing said first passageway means to be interconnected to said second passageway means upon the engine cooling fluid reaching a temperature of said predetermined magnitude.

3. An apparatus according to claim 1, wherein said automatic choke mechanism is temperature responsive and includes a temperature-responsive setting member operatively interconnected to said choke valve, said choke mechanism also including linkage means interconnected between said temperature-responsive member and said fast idle cam.

4. An apparatus according to claim 1, wherein said pressure-responsive actuator means includes a diaphragm-type actuator which separates first and second pressure chambers, said passage means being in continuous communication with said first chamber so that same is in selected communication with either the surrounding atmosphere or the intake manifold due to the position of said valve means, and said second chamber being in continuous communication with the surrounding atmosphere.

5. In combination with an internal combustion engine having an intake manifold, a movable choke valve associated with said intake manifold, a movable throttle valve associated with said manifold and disposed downstream of the choke valve, an automatic temperature-responsive choke mechanism operatively interconnected between said choke and throttle valves for controlling the position thereof during warmup of the engine, said choke mechanism including a fast idle cam coacting with the throttle valve for holding same in a fast idle position during warmup of the engine, and ignition switch means for controlling the starting and stopping of the engine, the improvement comprising control means coacting directly with the automatic choke mechanism for forceably moving the fast idle cam away from said fast idle position so that the said throttle valve can return to its substantially closed position when the engine is stopped due to said ignition switch means being opened, said control means including:

pressure responsive actuator means having associated therewith a fluid pressure chamber and a movable actuator member, said actuator member being normally maintained in a first position when the engine is operating and in a second position spaced from said first position when the engine is stopped;

link means coacting between said movable actuator member and said automatic choke mechanism for causing movement of said fast idle cam away from said fast idle position to permit said throttle valve to move towards its closed position when the actuator member is moved from said first position into said second position;

conduit means for supplying a pressure fluid to said chamber;

first passage means in communication with the atmosphere and adapted for communication with said conduit means;

second passage means in communication with the intake manifold and adapted for communication with said conduit means;

changeover valve means coacting with said conduit means and said first and second passage means for permitting said conduit means to selectively communicate with either of said first and second passage means, said valve means normally maintaining said first passage means in communication with said conduit means when said ignition switch means is closed for maintaining said movable actuator member in said first position; and means for activating said changeover valve means to connect said conduit means to said passage means in response to the ignition switch means being opened, whereby connecting said actuator means to said intake manifold causes movement of said actuator member into said second position.

6. The combination according to claim 5, wherein said automatic choke mechanism includes a temperature-responsive element and a lost-motion linkage connected between said temperature responsive element and said fast idle cam, and said link means being connected directly to said fast idle cam for forceably moving same away from said fast idle position when said actuator member is moved into said second position.

7. The combination according to claim 5, wherein said automatic choke mechanism includes linkage means operatively connected between said fast idle cam and said choke valve, and said link means being interconnected to said linkage means for moving same in response to movement of said actuator member into said second position for both moving said fast idle cam away from said fast idle position and moving said choke valve away from its closed position.

* * * * *

UNITED STATES PATENT AND TRADEMARK OFFICE

CERTIFICATE OF CORRECTION

PATENT NO. : 4 016 852

DATED : April 12, 1977

INVENTOR(S) : Masami Konishi and Hiromichi Yanagihara

It is certified that error appears in the above-identified patent and that said Letters Patent are hereby corrected as shown below:

Column 7, line 2: change "said passage" to ---said second passage---

Signed and Sealed this

*fifth* Day of *July 1977*

[SEAL]

*Attest:*

RUTH C. MASON
*Attesting Officer*

C. MARSHALL DANN
*Commissioner of Patents and Trademarks*